US010514200B2

(12) United States Patent
Miller

(10) Patent No.: US 10,514,200 B2
(45) Date of Patent: Dec. 24, 2019

(54) EFFICIENT VARIABLE CAPACITY CHILLED WATER PLANT DESIGN WITH REDUCED MECHANICAL COOLING AND THERMAL STORAGE

(71) Applicant: Tesla, Inc., Palo Alto, CA (US)

(72) Inventor: Jacob Andrew Miller, Reno, NV (US)

(73) Assignee: Tesla, Inc., Palo Alto, CA (US)

( * ) Notice: Subject to any disclaimer, the term of this patent is extended or adjusted under 35 U.S.C. 154(b) by 66 days.

(21) Appl. No.: 15/873,274

(22) Filed: Jan. 17, 2018

(65) Prior Publication Data

US 2018/0202710 A1 Jul. 19, 2018

Related U.S. Application Data

(60) Provisional application No. 62/446,963, filed on Jan. 17, 2017.

(51) Int. Cl.

| | |
|---|---|
| ***F25D 31/00*** | (2006.01) |
| ***F28C 1/00*** | (2006.01) |
| ***F25B 1/04*** | (2006.01) |
| ***E04H 5/12*** | (2006.01) |
| ***F25B 25/00*** | (2006.01) |
| *F25B 41/00* | (2006.01) |
| *F25B 39/00* | (2006.01) |

(52) U.S. Cl.

CPC ..... *F25D 31/002* (2013.01); *E04H 5/12* (2013.01); *F25B 1/04* (2013.01); *F25B 25/005* (2013.01); *F28C 1/00* (2013.01); *F25B 39/00* (2013.01); *F25B 41/00* (2013.01); *F25B 2339/047* (2013.01); *F25B 2500/05* (2013.01); *F25B 2500/18* (2013.01); *F28C 2001/006* (2013.01)

(58) Field of Classification Search

CPC .... F25D 31/002; F25D 29/003; F25B 25/005; F25B 1/04; F25B 2339/047; F25B 39/00; F25B 2500/05; F25B 41/00; F25B 2500/18; E04H 5/12; F28C 1/00; F28C 2001/006; F24F 5/0003; F24F 5/0042; F24F 3/10; F24F 3/001; F24F 3/06

See application file for complete search history.

*Primary Examiner* — Emmanuel E Duke

(74) *Attorney, Agent, or Firm* — Knobbe, Martens, Olson & Bear, LLP

(57) ABSTRACT

A system configuration for a chilled water plant is described in which mechanical cooling is reduced in favor of less energy intensive ambient dry or evaporative cooling. While the system sees the greatest performance improvement in dry and cool climates, considerable energy savings may be realized in a variety of climate zones. Less facility hardware is required for the same amount of total cooling capacity, reducing the overall cost of the plant.

9 Claims, 7 Drawing Sheets

| WET BULB TEMP (°F) | CHILLED WATER RETURN TEMP (°F) | TOWER PRODUCT WATER TEMP (°F) | ECONOMIZER OUTLET TEMP (°F) | ECONOMIZER FLOW RATE (°F) | CHILLER OUTLET TEMP/SUPPLY TEMP (°F) | CHILLER FLOW RATE (gpm) | ECONOMIZER LOAD (TONS) | CHILLER LOAD (TONS) |
|---|---|---|---|---|---|---|---|---|
| 40 | 62 | 48 | 50 | 2000 | 50 | 0 | 1000 | 0 |
| 42 | 62 | 48 | 50 | 2000 | 50 | 0 | 1000 | 0 |
| 44 | 62 | 48 | 50 | 2000 | 50 | 0 | 1000 | 0 |
| 46 | 62 | 50 | 52 | 2000 | 50 | 2000 | 833 | 167 |
| 48 | 62 | 52 | 54 | 2000 | 50 | 2000 | 667 | 333 |
| 50 | 62 | 54 | 56 | 2000 | 50 | 2000 | 500 | 500 |
| 52 | 62 | 56 | 58 | 2000 | 50 | 2000 | 333 | 667 |
| 54 | 62 | 58 | 60 | 2000 | 50 | 2000 | 167 | 833 |
| 56 | 62 | 60 | 62 | 0 | 50 | 2000 | 0 | 1000 |
| 58 | 62 | 62 | 62 | 0 | 50 | 2000 | 0 | 1000 |
| 60 | 62 | 64 | 62 | 0 | 50 | 2000 | 0 | 1000 |

TABLE 1

*FIG. 5*

| WET BULB TEMP (°F) | CHILLED WATER RETURN TEMP (°F) | TOWER PRODUCT WATER TEMP (°F) | ECONOMIZER OUTLET TEMP (°F) | ECONOMIZER FLOW RATE (°F) | CHILLER OUTLET TEMP/SUPPLY TEMP (°F) | CHILLER FLOW RATE (gpm) | ECONOMIZER LOAD (TONS) | CHILLER LOAD (TONS) |
|---|---|---|---|---|---|---|---|---|
| 40 | 62 | 48 | 50 | 3x2000 | 50 | 0 | 3000 | 0 |
| 42 | 62 | 48 | 50 | 3x2000 | 50 | 0 | 3000 | 0 |
| 44 | 62 | 48 | 50 | 3x2000 | 50 | 0 | 3000 | 0 |
| 46 | 62 | 50 | 52 | 3x2000 | 50 | 6000 | 2500 | 500 |
| 48 | 62 | 52 | 54 | 3x2000 | 50 | 6000 | 2000 | 1000 |
| 50 | 62 | 54 | 56 | 3x1333 | 50 | 4000 | 1000 | 1000 |
| 52 | 62 | 56 | 58 | 3x1000 | 50 | 3000 | 500 | 1000 |
| 54 | 62 | 58 | 60 | 3x800 | 50 | 2400 | 200 | 1000 |
| 56 | 62 | 60 | 62 | 0 | 50 | 2000 | 0 | 1000 |
| 58 | 62 | 62 | 62 | 0 | 50 | 2000 | 0 | 1000 |
| 60 | 62 | 64 | 62 | 0 | 50 | 2000 | 0 | 1000 |

TABLE 2

*FIG. 6*

| PLANT COMPARISON | TRADITIONAL PLANT | PLANT OF FIG.2 |
|---|---|---|
| CAPACITY (TONS) | 3000 | 1000-3000 |
| WATER FLOW (GPM) | 6000 | 2000-6000 |
| # OF 1000 TON CHILLERS | 3 | 1 |
| # OF 1000 TON COOLING TOWERS | 3 | 4 |
| # OF 1000 TON HEAT EXCHANGERS | 3 | 3 |
| # OF 6000 GPM PRIMARY PUMPS | 1 | 1 |
| # OF CONDENSER/TOWER PUMPS | 3 | 4 |
| THERMAL STORAGE SYSTEM | NO | YES |

TABLE 3

*FIG. 7*

EFFICIENT VARIABLE CAPACITY CHILLED WATER PLANT DESIGN WITH REDUCED MECHANICAL COOLING AND THERMAL STORAGE

CROSS-REFERENCE TO RELATED APPLICATIONS

The present U.S. Utility patent application claims priority pursuant to 35 U.S.C. § 119(e) to U.S. Provisional Application No. 62/446,963, entitled "EFFICIENT VARIABLE CAPACITY CHILLED WATER PLANT DESIGN WITH REDUCED MECHANICAL COOLING AND THERMAL STORAGE", filed Jan. 17, 2017, which is hereby incorporated herein by reference in its entirety for all purposes.

TECHNICAL FIELD

The present disclosure relates generally to the cooling of a facility and equipment, specifically, to an efficient chilled water plant design for facility and equipment temperature control (often building air-conditioning).

BACKGROUND

Heating and cooling of factories is responsible for a significant portion of total building utility costs in addition to multimillion dollar capital equipment investments. Conventional systems are designed for a wide range of operating environments and therefore do not provide optimal solutions for a building in a specific environment. It is an object of the current disclosure to provide an efficient cooling system for a building, particularly one in which the environment is often dry and cool at night.

SUMMARY

The present disclosure describes a cooling system. The cooling system has a first hydronic loop and a second hydronic loop. First hydronic loop has a heat exchanger and a cooling tower coupled to each other in series. The second hydronic loop has a chiller and a cooling tower coupled to each other in series. A chilled-water loop is thermally connected to first hydronic loop and second hydronic loop. Chilled-water loop is connected such that chilled-water loop may bypass first hydronic loop or second hydronic loop. The present disclosure further includes a third hydronic loop, and a fourth hydronic loop. Each of third hydronic loop and fourth hydronic loop has a heat exchanger and a cooling tower coupled to each other in series. The third hydronic loop and fourth hydronic loop are connected in parallel with first hydronic loop. Such connections between different hydronic loops allow a combination of mechanical and non-mechanical cooling to be used with chiller plants, and provides with efficient cooling systems on all types of days such as hot, dry, and/or humid. Specific combinations may be used for mechanical and non-mechanical cooling components to provide most efficient cooling solution for a building, factory or any other such system where cooling system is being used.

BRIEF DESCRIPTION OF THE FIGURES

FIG. 5 illustrates a first table showing data corresponding to conventional chiller plant shown in FIG. 1, according to certain embodiments of the present disclosure.

FIG. 6 illustrates a second table showing data corresponding to chiller plant shown in FIG. 2, according to certain embodiments of the present disclosure.

FIG. 7 illustrates a third table showing comparison between two types of chiller plants according to certain embodiments of the present disclosure.

DETAILED DESCRIPTION

Centralized heating and cooling plants, rather than small distributed heating and cooling plants, can improve efficiency and reduce costs. Added thermal energy storage ("TES") systems can further increase savings and reduce operating costs. TES systems are advantageous as they allow a plant to produce more cold water at night when both electricity costs and ambient temperatures (which impact plant performance) are low and then use the stored water during the day when it would be more expensive to operate a chiller. However, relying solely on stored chilled water to cool a facility can require large thermal storage tanks and have a large initial cost. The current disclosure combines the use of TES tanks with a chiller and cooling towers to create an efficient and cost effective cooling solution. The present disclosure provides systems that create operational savings without high initial equipment and installation costs.

The present disclosure utilizes TES to minimize the need for chillers to provide cooling. This reliance on TES is particularly suited for implementation in climates that are fairly dry and cool at night. However, even if the day time is hot, the present disclosure can save on cooling costs if the night is dry and cool. The present disclosure illustrates ways to reduce cooling costs by generating chilled water at night that can then be used during warmer times to cool a building or factory, manufacturing processes, and equipment. The more chilled water that can be generated at night, or under cool conditions, the larger the potential savings and the lower the potential cost to chill equipment and processes in the factory.

Figure 1:
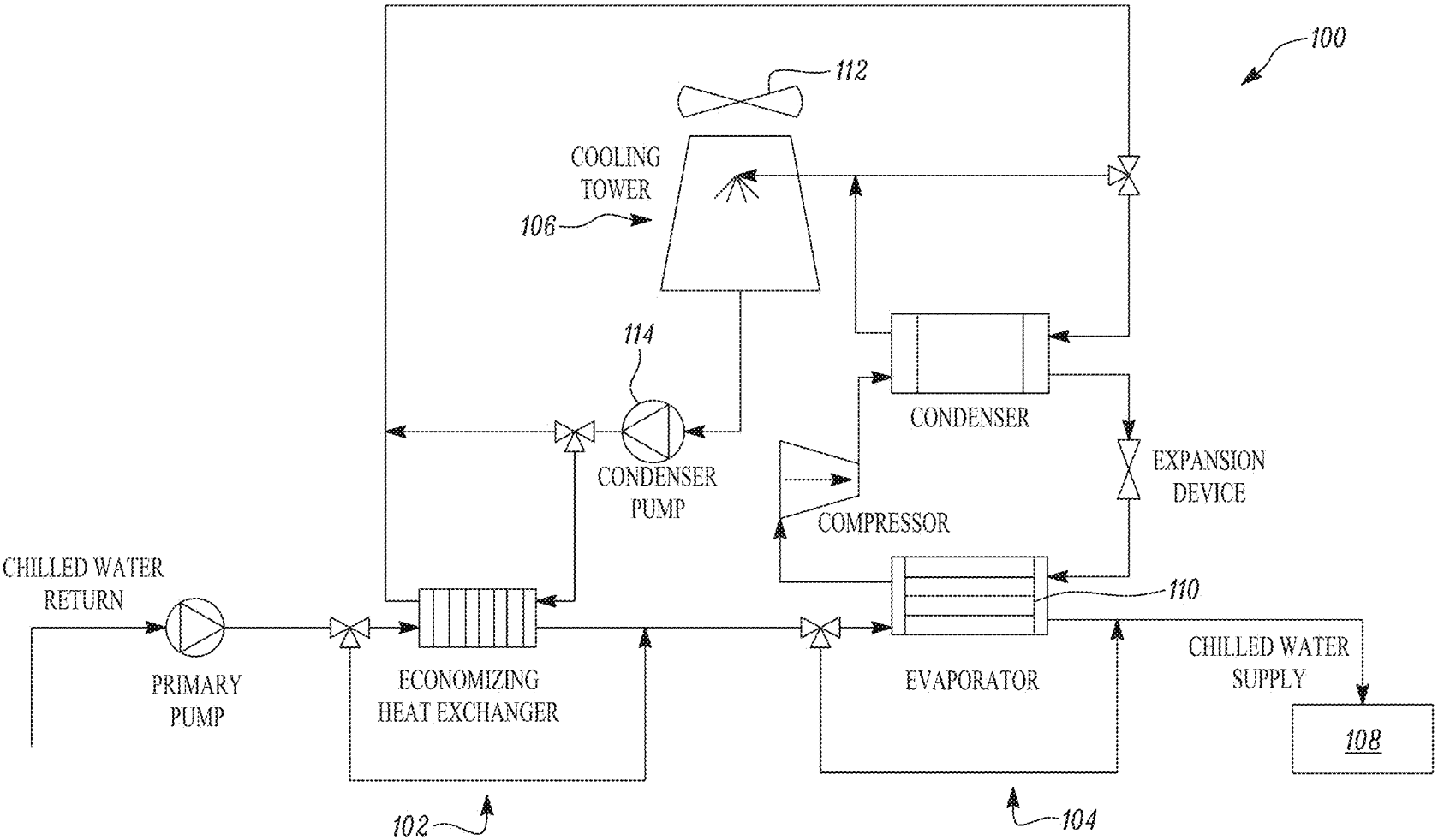
FIG. 1 PRIOR ART
FIG. 1 illustrates a conventional chilled water system.

FIG. 1 illustrates a conventional chilled water system 100 with waterside economizer 102. As can be seen in FIG. 1, the economizer 102 is in series with a chiller 104 in a hydronic loop. The economizer 102 enables offloading of the chiller 104 when economizing is possible. Water-cooled chillers 104 produce chilled water for use in a variety of residential, commercial, and industrial applications. Typically, the chilled water is fed to a building's HVAC system (not shown) (or other process cooling systems) to provide a means of useful cooling inside the space, both latent and sensible. As the water absorbs heat from the building, it warms and is returned to the chiller 104, completing a closed loop.

The chiller 104 itself can be one of many varieties, but a centrifugal compressor-driven vapor compression cycle is typical among large installations. A vapor compression machine is a type of heat pump in which a process fluid (in this case, water) is cooled and heat is pumped/rejected to another medium. In the example case, heat is rejected into a separate water stream. This warmed water is then cooled by way of a cooling tower 106 or other means of rejecting heat to the ambient air.

Vapor compression cycles are efficient cooling cycles in that the amount of heat transferred is typically greater than the input of work to power the system. For example, a centrifugal chiller may consume 1 unit of electricity to produce 10 units of cooling. Despite their high efficiency, large machines still consume large amounts of electricity, often in the hundreds or even thousands of kilowatts (kW). To reduce electrical consumption, many machines have been equipped with devices known as water-side economizers. These economizers use ambient air to partially or fully cool the warm return water in a chilled water system to offset the amount of mechanical cooling performed by the chiller. Cooling towers and dry-coolers have been successfully used to displace chiller mechanical cooling with non-mechanical cooling which consumes less electricity. Typically, pumps and fans are run in cooling towers and dry coolers instead of the compressor of the chiller, resulting in a smaller consumption of electricity of the same amount of useful cooling.

On cool or dry days, the cooling tower 106 operates to produce cold water that is cooler than the desired chilled water supply temperature. This cooling tower water is circulated through the economizing heat exchanger 102 to directly cool the warm return water on the other side of the heat exchanger 102. In this mode, the chiller 104 remains off and the cool water coming out of the economizer 102 bypasses the chiller 104, going directly to the chilled water distribution system 108. On hot or humid days, return water bypasses the economizer 102, instead going to the chiller 104. The cooling tower 106 still operates, but here cannot make water cool enough to directly cool the return water. Instead, the water exiting the cooling tower 106 is sent to the chiller's condenser 110 to provide a means of heat rejection while operating the chiller 104. The return water is cooled in the chiller 104 before being sent back out as supply water. On "medium" days, the cooling tower 106 generates relatively cold water, but not cold enough to directly cool the return water all the way to the desired set point. Here, return water is sent through the economizer 102 and is partly cooled. It is then further cooled to the desired set point in the chiller 104. In this mode, the chiller 104 still operates but at a lower load, reducing electric power consumption. Cooling tower water is first sent to the economizer 102 to directly cool the return water, and then to the condenser 110 to provide cooling for the vapor compression cycle.

In general, it is desirable to run in economizer mode or partial economizer mode because these modes are less power intensive. Running the cooling tower fans 112 and pumps 114 will require less electric power than the chiller 104. Additionally, in instances of using wet cooling towers to reject heat, water savings are realized in economizing mode as the towers see a reduced load. Operating a chiller 104 increases the load on the tower because the chiller 104 is rejecting both heat from the incoming return water as well as heat generated in the chiller's compressor 110.

The ability to run in economizing mode is limited by the outdoor, or ambient, conditions as well as the desired chilled water supply temperature set point. For example, the chilled water supply set point may be 50° F. and the return temperature 62° F. If the cooling tower approach (temperature difference between ambient wet bulb and tower product water) is 4° F., and the economizing heat exchanger approach (temperature difference between leaving chilled water and entering tower water) is 2° F., whenever the outdoor wet bulb is 44° F. or less (44+4+2=50), the cooling tower 106 can produce cold enough water (in this case, 48° F.) to cool the chilled water to the desired 50° F. set point without use of the chiller 104. Should the wet bulb exceed 44° F., the chiller 104 must be activated to provide some or all of the cooling.

Conventional chiller plant configurations are limited to a certain temperature range during which economizing can be operational. For example, if the plant mentioned above has a 1000 ton cooling capacity, when the wet bulb is below 44° F., the plant delivers 1000 tons of non-mechanical (evaporative cooling). If the wet bulb reaches 56° F., the plant must deliver 1000 tons of mechanical cooling (chiller 104 fully loaded) because the economizer 102, if used, would be unable to cool the return water below the 62° F. it arrives at (56+4+2=62). On a day where the wet bulb is 50° F., the economizer 102 could cool the 62° F. return water to 56° F. (50+4+2=56). Here, half the cooling (500 tons) is non-mechanical: the cooling towers 106 and economizer 102 cool the return water from 62 to 56° F. The remaining half of the cooling (500 tons) is mechanical: the chiller 104 cools the water the rest of the way from 56 to 50° F.

Figure 2:
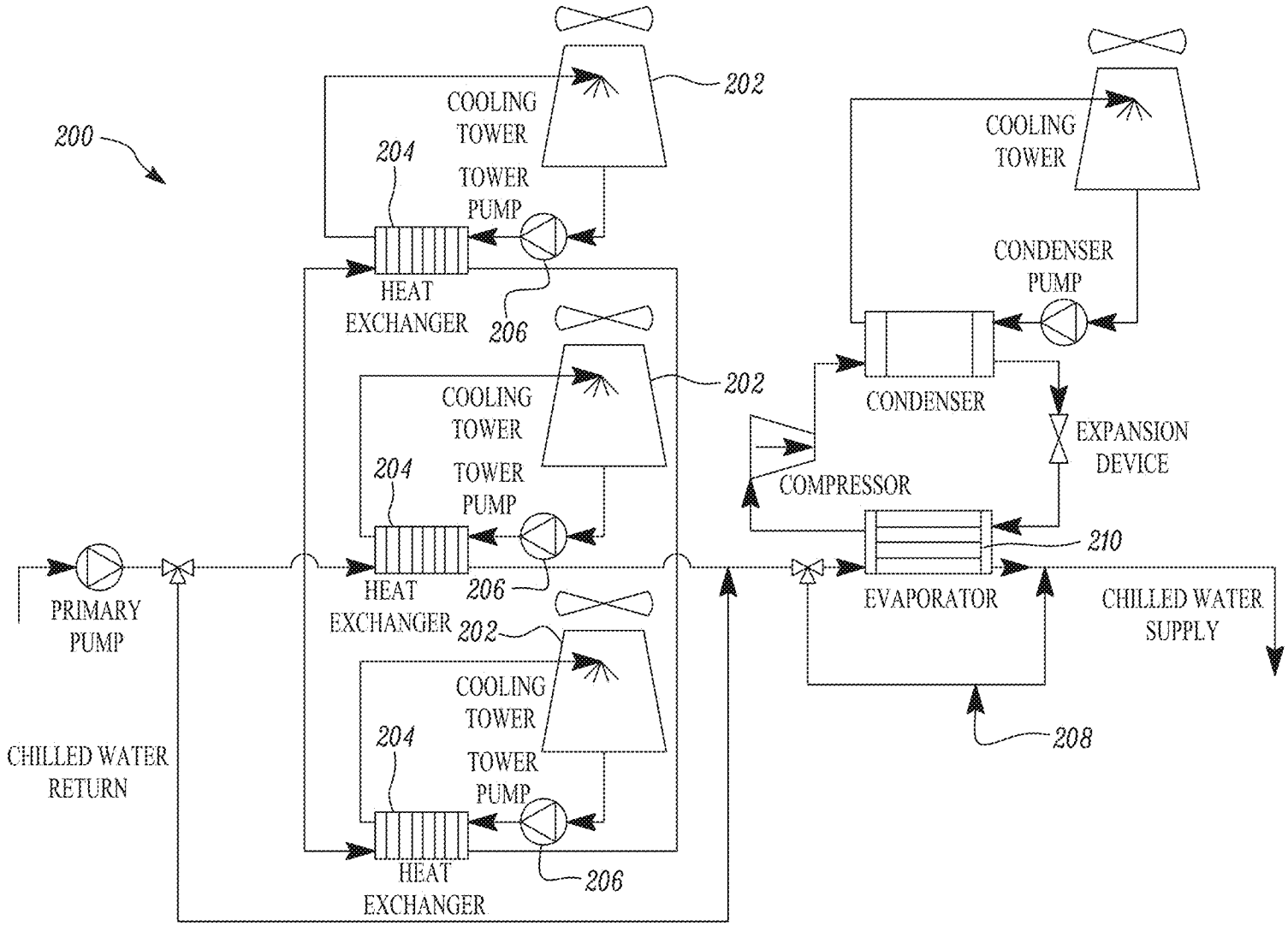
FIG. 2 illustrates a chiller plant according to certain embodiments of the present disclosure.

FIG. 2 illustrates a chiller plant 200 according to certain embodiments of the present disclosure. Multiple cooling towers 202, each with a heat exchanger 204 and tower pump 206, are located upstream of a chiller 208 (connected through hydronic connections). The chilled water loop passes warm return water through the cooling towers' heat exchangers 204 (a type of thermal connector) and then to the chiller 208, exchanging heat through a thermal connector such as an evaporator 210, before sending the cool water to supply the building loads (not shown). These towers 202 enable offloading of the chiller 208 when economizing is possible. Other chillers and/or other hydronic loops containing cooling towers 202 may be connected in parallel with each other. FIG. 2 illustrates three such hydronic loops, each containing an economizer 204 and cooling tower 202, connected in parallel. The same may be accomplished with one very large cooling tower (and associated heat exchanger and pump) rather than multiple smaller units. Also, while the cooling towers 202 shown here are open-loop wet towers, closed circuit coolers operating in either wet or dry cooling mode could be utilized in an equivalent fashion. The cooling towers 202 generate additional cold water when the outdoor ambient temperatures and humidity are low. In cold and dry climates, these conditions may exist every, or almost every, night.

When the outdoor temperature and humidity is higher, the cooling towers 202 perform part of the cooling while the chiller 208 performs the remainder of the cooling. When outdoor temperatures are very high, the cooling towers 202 may not be used to directly cool the return water. In such cases, cooling is provided by the chiller 208 only. When outdoor temperatures are low, the plant 200 can generate a lot of cold water very efficiently (using the cooling towers 202). When outdoor temperatures are high, the overall plant output is reduced. However, when paired with a sufficiently large thermal storage system, the complete system satisfies the building's demand by generating a surplus of cold water at night to be used during the next day when the plant 100 has a reduced maximum chilled water output.

Selectively using the cooling towers 202 and/or chiller 208 is accomplished through the connection with the chilled-water loop. As can be observed in FIG. 2, the chilled-water loop can bypass all or any individual hydronic loop containing the exchanger 204 and cooling tower 202. The chilled-water loop can also bypass the chiller 208. The water within the chilled-water loop may contain ethylene glycol or other impurity intended to vary the cooling properties within the loop.

In certain embodiments, a cooling tower with a larger capacity is paired with a chiller that has a smaller capacity relative to the cooling tower. This allows the chiller use to be maximized. The chiller is operated to generate the maximum capacity of cold water while flow rates and water temperatures are varied.

The present disclosure preferentially adds additional cooling capacity through cooling towers 202 over chillers 208. Adding a cooling tower 202 is advantageous because adding one is far less expensive than adding an additional chiller 208. The savings are often sufficient to negate (or more than negate) the added cost of the TES tanks. Further, the combined system operates at a lower operational cost. Modeling shows that the electrical energy cost of the chilled water plant 200 according to the present disclosure saves about 30% per year over a baseline plant with no thermal storage in a dry, alpine climate.

By adding more non-mechanical cooling capacity and adjusting the operating parameters of the plant 200, the plant 200 can deliver the full cooling capacity for the majority of the year. As non-mechanical cooling (e.g. cooling towers 202) is significantly less expensive the mechanical cooling (e.g. vapor compression cycle chillers), the overall plant cost is reduced. The plant delivers a variable cooling capacity per the outdoor ambient conditions. When outdoor conditions are cool and/or dry, the plant 200 operates a full capacity. The plant 200 operates at a reduced capacity on particularly hot and/or humid days. As hot/humid days typically result in a greater cooling demand, the reduced output of the chilled water plant 200 can be managed by the addition of a thermal storage system. The plant 200 then may run at full capacity during cooler and drier hours (at night, for instance), charging the thermal storage system. When the plant output is reduced during hot and humid hours (during daylight hours in the summer), the thermal storage system supplies the additional capacity required to meet the demand of the building.

The present disclosure also utilizes the fact that most chillers 208 can handle a very wide range of flow rates and chilled water temperature differences across the evaporator barrel. By pairing a greater amount of non-mechanical cooling with the chiller 208, flow rates and the design change in temperature across the chiller 208 ("delta T") may be adjusted to maximize the output utilization of both mechanical and non-mechanical capacity. The result is a plant that costs less upfront and is cheaper to operate, because it uses less energy than a typical arrangement.

The present disclosure reduces the total cost of the chiller plant 200 while delivering the same cooling capacity for the majority of the year compared to conventional systems. To achieve a lower capital cost, the ratio between non-mechanical and mechanical cooling is adjusted. The conventional plant 100 shown in FIG. 1 has a 1:1 ratio of non-mechanical to mechanical cooling (in the example above, 1000 tons of evaporative cooling in the cooling towers to 1000 tons of mechanical cooling in the chiller). The improved plant 200 in FIG. 2 has a 3:1 ratio (3000 tons of evaporative cooling to 1000 tons of chiller cooling).

Comparing a conventional system to an embodiment of the present disclosure in FIG. 2, the embodiment of the cooling system shown in FIG. 2 exhibits a greater evaporative cooling capacity upstream of the chiller 208. The chiller capacity remains the same, but the evaporative cooling capacity has been tripled. Return water from the building is first cooled by evaporative cooling towers 202, when the outdoor wet bulb temperature is low enough to generate sufficiently cold water in the cooling towers 202. Water then heads to the chiller 208 for further cooling, unless if the outdoor wet bulb temperature is sufficiently low, the return water is cooled to the desired supply temperature in the cooling towers 202 and bypasses the chiller 208. When the outdoor wet bulb temperature is too high, water bypasses the cooling tower 202 and heads to the chiller 208.

By tripling the capacity of cooling tower 202 for the single chiller 208, the plant 200 has a variable output capacity linked to the outdoor conditions. An example performance summary of a traditional plant is compared against this improved plant 200 in Tables 1 (shown in FIG. 5) and 2 (shown in FIG. 6), respectively. The new plant 200 summarized in Table 2, particularly in drier climates, can generate its full 3000-ton capacity for the majority of the year at a far lower cost than three 1000-ton chillers 208 or even one 3000-ton chiller 208. However, on more humid days the plant capacity begins to fall. For most buildings, a more humid day generally corresponds with a higher demand for cooling. Typically, it would be undesirable to have lower capacity during hours in which the demand is higher, but this issue can be managed by the addition of a thermal storage system. A thermal storage system, such as a large stratified chilled water tank, can manage the peak load of hot and humid hours by allowing the system to generate additional cold water at night when the ambient dry and wet bulb temperatures are low and store it in the thermal storage tank. During the day when both cooling demand is high and plant output is lower (due to higher humidity), the tank is discharged.

The system of the present disclosure further describes how to efficiently use the chiller 208. There is a lower and upper limit to the flow rate of water that can be cooled in the chiller 208, but typically this range is wide, often a 10:1 ratio between maximum and minimum flow. The chiller system shown in FIG. 2 and Table 2 utilizes this chiller 208 turn down ratio to always deliver the maximum 1000 tons of cooling, even when some cooling has already been performed in the economizer 204/cooling towers 202. For example, when the outdoor wet bulb temperature is 48° F., the return water from the building is cooled from 62 to 54° F. The chiller 208 then must cool the 54° F. water to the desired supply temperature of 50° F. This is a delta T of only 4° F., where the chiller's design condition allows for a 12° F. change in temperature. Thus, three times as much water is passed through the chiller 208 (6000 gpm instead of 2000 gpm) so that the full 1000 tons of cooling capacity can be generated in the chiller 208. At a 50° F. wet bulb temperature, the economizer 204 can only cool the return water to 56° F. Now, the delta T across the chiller 208 is 6° F., so the water flow rate is two times the nominal (4000 gpm vs. 2000 gpm). If the standard arrangement shown in FIG. 1 and Table 1, the water flow rate is fixed, with the chiller 104 being offloaded in certain scenarios. In the new configuration, the chiller 208 is fully utilized to produce its fully cooling capacity in most conditions. Though more electrical power is consumed to keep the chiller 208 running at full capacity, the cooling output is maximized in order to recharge the thermal storage system as quickly as possible, enabling it to have more chilled water in reserve for the particularly hot/humid hours. Additionally, by increasing the flow rate through the chiller 208 during hours with a higher wet bulb temperature, the combined chiller/tower system 200 is able to produce more chilled water than the system 100 exhibited in FIG. 1 with the only downside being slightly more pumping power is required. Finally, by pairing the system 200 with thermal storage, more load can be generated in the cooler/drier hours so that the total yearly power consumption of the plant 200 may be reduced.

Table 3 (shown in FIG. 7) summarizes the difference in capital expenditures for a plant 200 of the present disclosure as shown in FIG. 2 and a traditional plant 100 shown in FIG. 1. Comparing the plant 200 of FIG. 2 to the traditional system, the plant 200 of FIG. 2 achieves the same cooling load during drier hours but has 2 few chillers 208 and just 1 additional pump 206 and tower 202. Additionally, the plant 200 of FIG. 2 utilizes thermal storage to manage the variable output. The cost reduction from removing two chillers 208 can negate the cost of adding a large thermal storage system and additional pump 206 and tower 202. Additionally, the plant 200 of FIG. 2 can operate more hours during the colder and less humid hours, saving operating costs in the form of electricity and water. Depending on the climate and operating conditions of the plant 200 and building, savings of 30-40% may be achievable.

Figure 3:
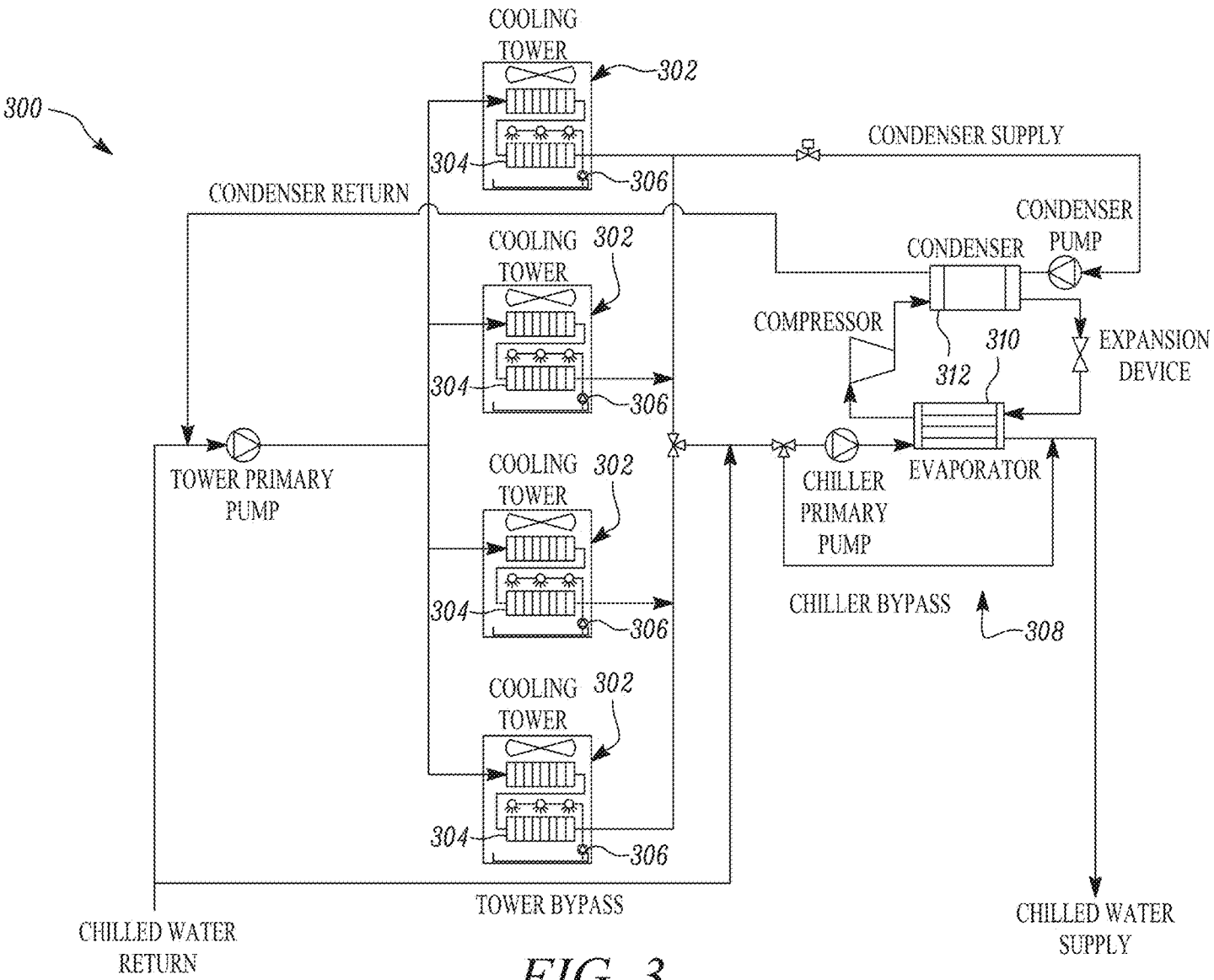
FIG. 3 illustrates a chiller plant according to certain embodiments of the present disclosure.

FIG. 3 illustrates a chiller plant 300 according to certain embodiments of the present disclosure. Four cooling towers 302, each with a heat exchanger 304 and tower pump 306, are located upstream of a chiller 308. However, in the embodiment described in FIG. 3, the four cooling towers 302 may serve either the direct cooling water needs or the chiller 308 in chiller only mode. That is, the four cooling towers 302 may produce chilled water to fully cool the closed loop water or alternatively, partially cool the cooling water that is further cooled by the chiller 308, depending on the outdoor ambient temperatures and humidity. More or fewer than four cooling towers 302 may be used depending on the cooling needs of the factory or facility.

As can be observed, the chilled-water hydronic loop may exchange heat with any of the four cooling towers 302 or directly from the chiller 308 through a thermal connector such as a heat exchanger or evaporator. The hydronic loop may also be set to bypass any or all of the four cooling towers 302 and the chiller 308. Depending on the ambient temperature and humidity, the water within the chilled-water hydronic loop may be cooled by any one of the four cooling towers 302, directly by the chiller 308, or any combination of the cooling towers 302 and the chiller 308. The water within the chilled-water hydronic loop may contain ethylene glycol or other impurity intended to vary the cooling properties within the loop.

All four towers 302 can be used for direct water cooling on cold and dry days. On mild days, the chilled water may be partially cooled in all four towers 302 with for example, the flow from three towers 302 flows to the chiller evaporator 310 and the flow from one tower 302 flows to the chiller condenser 312. On hot and humid days, the return chilled water flows to the evaporator 310 and bypasses all four towers 302. The towers 302 are then used to only cool the condenser 312 of the chiller 308.

Similar to the embodiments disclosed in FIG. 2, by adding more non-mechanical cooling capacity and adjusting the operating parameters of the plant 300, the plant 300 can deliver the full cooling capacity for the majority of the year. As non-mechanical cooling (e.g. cooling towers) is significantly less expensive the mechanical cooling (e.g. vapor compression cycle chillers), the overall plant cost is reduced. The plant 300 delivers a variable cooling capacity per the outdoor ambient conditions. When outdoor conditions are cool and/or dry, the plant 300 operates a full capacity. The plant 300 operates at a reduced capacity on particularly hot and/or humid days. As hot/humid days typically result in a greater cooling demand, the reduced output of the chilled water plant can be managed by the addition of a thermal storage system. The plant 300 then may run at full capacity during cooler and drier hours (at night, for instance), charging the thermal storage system. When the plant output is reduced during hot and humid hours (during daylight hours in the summer), the thermal storage system supplies the additional capacity required to meet the demand of the building.

The present disclosure can also utilize the variable nature of chillers 308 that can handle a very wide range of flow rates and chilled water temperature differences across the evaporator barrel. By pairing a greater amount of non-mechanical cooling with the chiller 308, flow rates and the design change in temperature across the chiller ("delta T") may be adjusted to maximize the output utilization of both mechanical and non-mechanical capacity. The result is a plant 300 that costs less upfront and is cheaper to operate, because it uses less energy than a typical arrangement.

Figure 4:
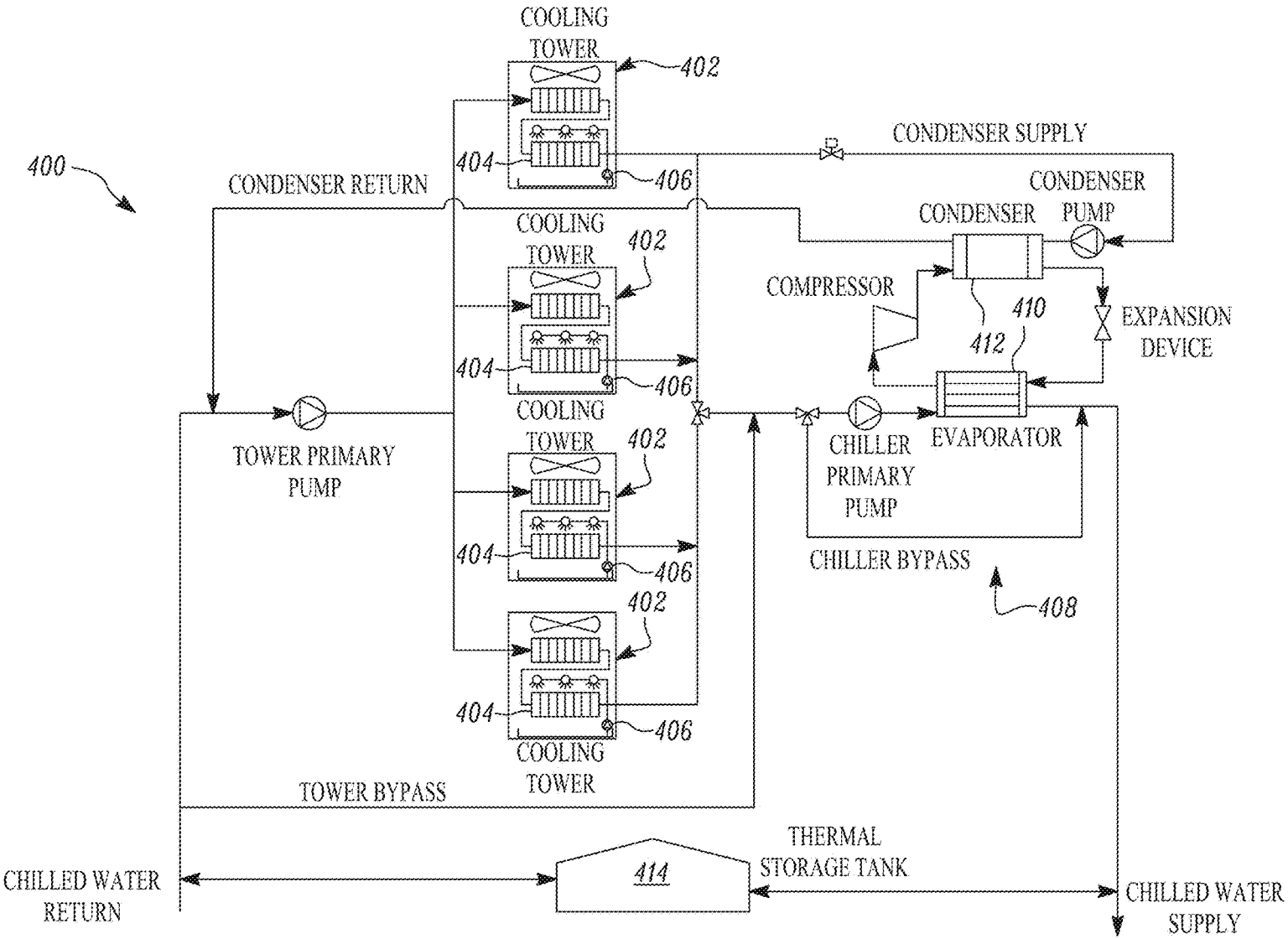
FIG. 4 illustrates a chiller plant according to certain embodiments of the present disclosure.

FIG. 4 illustrates a chiller plant 400 according to certain embodiments of the present disclosure. The embodiment of FIG. 4 is similar to the embodiment of FIG. 3 with the addition of a thermal storage tank 414 that is connected to the chilled-water hydronic loop. When cool and dry ambient temperatures exist or when power is less expensive, cooled water can be generated and then heat can be extracted from the water within the chilled-water hydronic loop. Excess cool water of the chilled-water hydronic loop may be stored in the thermal storage tank 414, meaning that the chilled-water hydronic loop contains more capacity to cool the different processes and equipment within the factory or facility.

In FIG. 4, four cooling towers 402, each with a heat exchanger 404 and tower pump 406, are located upstream of a chiller 408. The four cooling towers 402 may serve either the direct cooling water needs or the chiller 408 in chiller only mode. That is, the four cooling towers 402 may produce chilled water to fully cool the closed loop water or alternatively, partially cool the cooling water that is further cooled by the chiller 408, depending on the outdoor ambient temperatures and humidity. More or fewer than four cooling towers 402 may be used depending on the cooling needs of the factory or facility.

As can be observed, the chilled-water hydronic loop may exchange heat with any of the four cooling towers 402 or directly from the chiller 408 through a thermal connector such as a heat exchanger 404 or evaporator. The hydronic loop may also be set to bypass any or all of the four cooling towers 402 and the chiller 408. Depending on the ambient temperature and humidity, the water within the chilled-water hydronic loop may be cooled by any one of the four cooling towers 402, directly by the chiller 408, or any combination of the cooling towers 402 and the chiller 408. The water within the chilled-water hydronic loop may contain ethylene glycol or other impurity intended to vary the cooling properties within the loop.

All four towers 402 can be used for direct water cooling on cold and dry days. On mild days, the chilled water may be partially cooled in all four towers 402 with for example, the flow from three towers 402 flows to the chiller evaporator 410 and the flow from one tower 402 flows to the chiller condenser 412. On hot and humid days, the return chilled water flows to the evaporator 410 and bypasses all four towers 402. The towers 402 are then used to only cool the condenser 412 of the chiller 408.

Similar to the embodiments disclosed in FIG. 2 and FIG. 3, by adding more non-mechanical cooling capacity and adjusting the operating parameters of the plant 400, the plant 400 can deliver the full cooling capacity for the majority of the year. As non-mechanical cooling (e.g. cooling towers 402) is significantly less expensive the mechanical cooling (e.g. vapor compression cycle chillers 408), the overall plant cost is reduced. The plant 400 delivers a variable cooling capacity per the outdoor ambient conditions. When outdoor conditions are cool and/or dry, the plant 400 operates a full capacity. The plant 400 operates at a reduced capacity on particularly hot and/or humid days. As hot/humid days typically result in a greater cooling demand, the reduced output of the chilled water plant can be managed by the addition of a thermal storage system. The plant 400 then may run at full capacity during cooler and drier hours (at night, for instance), charging the thermal storage system. When the plant output is reduced during hot and humid hours (during daylight hours in the summer), the thermal storage system supplies the additional capacity required to meet the demand of the building.

The present disclosure can also utilize the variable nature of chillers 408 that can handle a very wide range of flow rates and chilled water temperature differences across the evaporator barrel. By pairing a greater amount of non-mechanical cooling with the chiller 408, flow rates and the design change in temperature across the chiller 408 ("delta T") may be adjusted to maximize the output utilization of both mechanical and non-mechanical capacity. The result is a plant 400 that costs less upfront and is cheaper to operate, because it uses less energy than a typical arrangement.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. For example, the above embodiments have focused on water cooling; however, different liquids can be use as part of the cooling system or additives, like ethylene glycol, may be added to the water or other liquid. Having thus described embodiments of the present disclosure, persons of ordinary skill in the art will recognize that changes may be made in form and detail without departing from the scope of the present disclosure. Thus, the present disclosure is limited only by the claims.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, a person of ordinary skill in the art will recognize that changes may be made in form and detail without departing from the scope of the present disclosure. Thus, the present disclosure is limited only by the claims.

In the foregoing specification, the disclosure has been described with reference to specific embodiments. However, as one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosed system, method, and computer program product. It is to be understood that the forms of disclosure herein shown and described are to be taken as representative embodiments. Equivalent elements, materials, processes or steps may be substituted for those representatively illustrated and described herein. Moreover, certain features of the disclosure may be utilized independently of the use of other features, all as would be apparent to one skilled in the art after having the benefit of this description of the disclosure.

As used herein, the terms "comprises," "comprising," "includes," "including," "has," "having" or any contextual variants thereof, are intended to cover a non-exclusive inclusion. For example, a process, product, article, or apparatus that comprises a list of elements is not necessarily limited to only those elements, but may include other elements not expressly listed or inherent to such process, product, article, or apparatus. Further, unless expressly stated to the contrary, "or" refers to an inclusive or and not to an exclusive or. For example, a condition "A or B" is satisfied by any one of the following: A is true (or present) and B is false (or not present), A is false (or not present) and B is true (or present), and both A and B is true (or present).

Although the steps, operations, or computations may be presented in a specific order, this order may be changed in different embodiments. In some embodiments, to the extent multiple steps are shown as sequential in this specification, some combination of such steps in alternative embodiments may be performed at the same time. The sequence of operations described herein can be interrupted, suspended, reversed, or otherwise controlled by another process.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically specified.

I claim:

1. A cooling system comprising:

a first hydronic loop with a heat exchanger and cooling tower in series;

a second hydronic loop with a chiller and cooling tower in series; and a chilled-water loop thermally connected to the first hydronic loop and the second hydronic loop, the chilled-water loop connected such that the chilled-water loop may bypass the first hydronic loop or the second hydronic loop.

2. The cooling system of claim 1 further comprising:

a third hydronic loop with a heat exchanger and cooling tower in series; and a fourth hydronic loop with a heat exchanger and cooling tower in series, wherein the third and fourth hydronic loops are connected in parallel with the first hydronic loop.

3. The cooling system of claim 2 wherein the chilled-water loop is connected to the third hydronic loop such that the chilled-water loop may bypass the third hydronic loop.

4. The cooling system of claim 1 wherein the chilled-water loop is connected to each of the first and second hydronic loops through either a thermal connection or an evaporator.

5. The cooling system of claim 1 wherein the cooling system has a greater than 1:1 ratio of non-mechanical to mechanical cooling.

6. The cooling system of claim 1 further comprising a thermal energy storage system thermally connected to the chilled-water loop.

7. The cooling system of claim 1, wherein the cooling tower includes a fan associated with the cooling tower.

8. The cooling system of claim 1, wherein the cooling tower includes a pump associated with cooling tower.

9. The cooling system of claim 1, wherein the chilled-water loop has an associated vapor compression cycle.

* * * * *